United States Patent [19]

Barron et al.

[11] Patent Number: 4,524,834

[45] Date of Patent: Jun. 25, 1985

[54] CABLEHEAD SIDE ENTRY SUB

[75] Inventors: Charles D. Barron; Felix Kuus, both of Gardena, Calif.

[73] Assignee: Smith International, Inc., Newport Beach, Calif.

[21] Appl. No.: 390,819

[22] Filed: Jun. 22, 1982

[51] Int. Cl.[3] ..... E21B 23/00

[52] U.S. Cl. ..... 166/385; 175/104; 166/387; 166/65 R; 174/65 R; 277/110

[58] Field of Search ..... 174/65 R; 277/110, 111; 166/65 R, 66, 84, 242, 385, 387; 175/45, 50, 104, 105

[56] References Cited

U.S. PATENT DOCUMENTS

| | | | |
|---|---|---|---|
| 2,283,117 | 5/1942 | Arutunoff | 174/68 R |
| 2,722,892 | 11/1955 | French | 417/422 |
| 4,062,551 | 12/1977 | Base | 277/102 |
| 4,128,735 | 12/1978 | Zehren | 174/65 R |
| 4,200,297 | 4/1980 | Tricon | 166/242 |
| 4,286,629 | 9/1981 | Streich et al. | 166/192 |

*Primary Examiner*—Stephen J. Novosad
*Assistant Examiner*—William P. Neuder
*Attorney, Agent, or Firm*—Christie, Parker & Hale

[57] ABSTRACT

Apparatus and method are disclosed for feeding a cablehead assembly into the side of a drill string. The cablehead is passed through a low angle side entrance in a side entry sub into the drill string. A cartridge assembly is seated in the side entrance around the cable to prevent pressure loss through the entry port. The cable is clamped to the outside of the sub to lock the cable in place. The cartridge assembly is thereafter tightened about the cable to seal against pressure loss. A cover plate is secured to the outside of the sub adjacent to the entry port to prevent expulsion of the cartridge.

35 Claims, 6 Drawing Figures

CABLEHEAD SIDE ENTRY SUB

FIELD OF THE INVENTION

The present invention provides a side entry sub for installing cable in earth boring drill strings where both the wireline and the cablehead assembly can be passed through the side entry sub without removing the sub from the string and without removing the cablehead from the wireline.

BACKGROUND OF THE INVENTION

When drilling oil or gas wells, it is frequently necessary to send electrical cables down the hollow drill string for the purposes of supplying instruments for monitoring the position and orientation of the drilling assembly. Under previous practices the cables were passed down the hollow interior of the pipes making up the drill string. If it was desired to continue drilling with the cable in place, it was necessary to withdraw the cable everytime a new section of drill pipe was to be added to the drill string. Such withdrawal of the cable was time consuming and costly.

One approach to this problem is to insert a wireline cable through the side of a section of drill pipe. The cable is connected to a cablehead assembly which is attached to the selected instrument.

U.S. Pat. No. 3,804,168 to Marshall and Myska disclosed a wireline clamp which is installed outside the well and the upper end of the drill string.

U.S. Pat. No. 4,200,297 to Tricon disclosed an arrangement where a wireline cable entered the side of a drill string through a side entry sub. The cable entering the sub negotiated a curvature which was too sharp to permit insertion of a cablehead assembly through the side entrance.

U.S. Pat. No. 4,062,551 to Base describes a side entry sub where a clamp is attached to the body of the sub. A wire packoff is integrated into the side entrance to seal against loss of drilling fluid pressure through the sub. The orifice receiving the packoff is made as narrow as possible so that the problem of guarding against pressure loss is minimized. The orifice is not wide enough to receive the cablehead assembly. Consequently the cablehead assembly cannot be passed through the side entry sub but instead must be attached to the wireline from inside the drill string.

There are several disadvantages to the above devices. In no case can a cablehead assembly be passed through a side entry sub. Only plain wireline can pass through the side entrance into the drill string. Consequently, the cablehead must be attached to the wireline on the rig floor after threading the wireline through the side entry sub. This operation must at times be performed in adverse climatic conditions and uncontrolled environments of cleanliness. The makeup and soldering of electrical connections can be inferior. Moreover, the time element required for fabricating laboratory or service shop quality connections on the rig floor reduces control of the well and increases cost of operations.

Another problem with the above devices is that the outside diameter of the side entry sub is typically not concentric, or not of the same diameter as the associated tool joints, or it has localized protrusions above standard API tool joint dimensions.

A third problem occurs because the transition radii of the wireline in passing from the outside of the drill string to the inside are generally small, the passing angles being on the order of about 15°. This increases wireline wear.

A major problem with the Base patent is that the wire must be packed off before the wireline is clamped. This sequence enables line movement and damage to the packings before on-line operations can begin. Thus possible leaks and washouts are threatened. Similarly, when coming out of the hole and terminating wireline operations, the cablehead in the Base patent must be cut off the wireline.

There is need for arrangements and procedures for introducing wireline cable into the side of a drill string which enable a cablehead assembly to be passed through the point of entrance.

SUMMARY OF THE INVENTION

This invention provides a cable head side entry sub for admitting a cable head assembly attached on a cable into a drill string through a side entrance in the drill string. The side entry sub comprises a cylindrical tubular sub body for attachment on a drill string. There is an entrance on the side of the body which is at least as wide as the cable head assembly to permit passage of the cable head assembly from outside of the body through the port and into the drill string. A cartridge assembly is provided for sealing the cable in the port against pressure loss. In use, the cartridge assembly is slidably seated in the port and comprises a cylindrical cartridge and a packoff gland each having a central passage for receiving the cable. The apparatus also comprises means for tightening the packoff gland into the cartridge to compress a packing element disposed in the cartridge about the cable to seal the cable, means for receiving the cartridge assembly in a fixed lateral position in the port, and means for clamping the cable to the outside of the body for preventing slipping of the cable laterally along the axis of the drill string.

In terms of method, the invention provides a method for introducing a cable head assembly into a drill string comprising disposing a cartridge assembly around a cable; attaching a cable head assembly to one end of the cable; and feeding the cable head assembly from outside the drill string through a side entrance in a member of the drill string into the drill string, the side entrance being sufficiently wide to admit the cable head assembly into the drill string along a path which forms an acute angle with a longitudinal axis of the member. The method also comprises feeding sufficient cable into the side entrance to lower the cable head assembly to a desired location inside the drill string; slidably seating the cartridge assembly in the side entrance; clamping the cable to the outside of the member to prevent further movement of the cable relative to the member; tightening the cartridge assembly around the cable to seal the cable against pressure loss through the cartridge assembly; and securing a cover plate to the outside of the member adjacent to the opening of the side entrance to prevent explusion of the cartridge assembly from the side entrance.

DESCRIPTION OF THE DRAWINGS

These and other features and advantages of the present invention will be better understood by reference to the following detailed description when considered with the accompanying drawings wherein.

DETAILED DESCRIPTION

Figure 1:
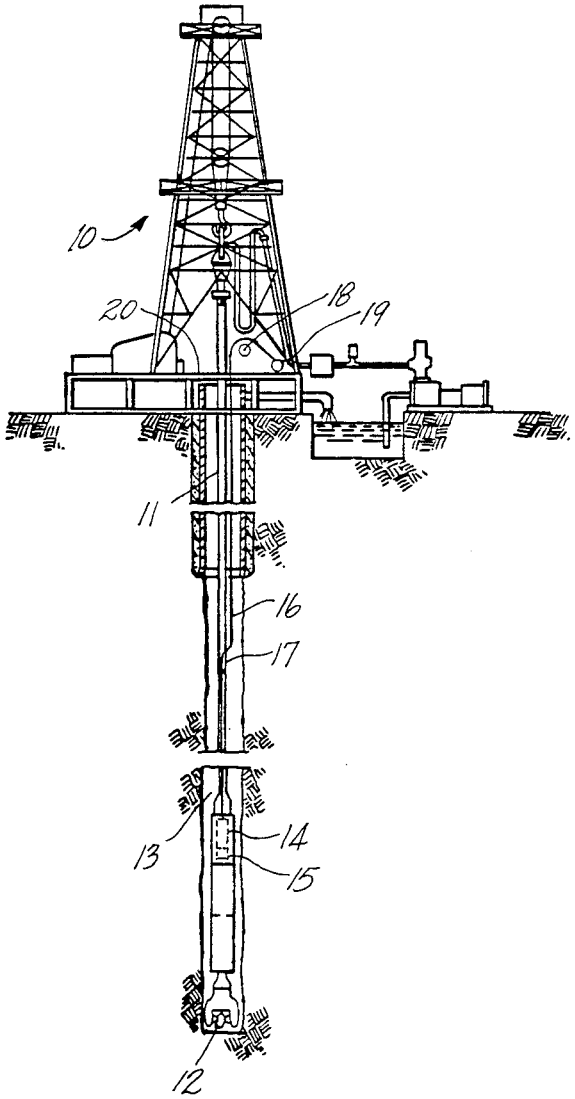
FIG. 1 is a perspective view of a drilling rig having a cablehead side entry sub according to this invention installed on a drill string.

A drill rig 10 is illustrated in FIG. 1 with a drill string 11 and a drill bit 12 in a subterranean borehole 13. A survey tool 15 is disposed in the lower portion of the drill string. The tool is mechanically and electrically connected to a cablehead assembly 14 on the end of a wireline cable 16. The cable enters the drill string through a side entry sub 17 which is made up on the drill string. Above the side entry sub, the wireline passes to the surface outside of the drill string and is paid through a pulley 18 from a winch 19 on the rig. Thus, at the drill rig floor 20, sections of drill pipe can be added or removed from the drill string without interference from the wireline cable.

Figure 2:
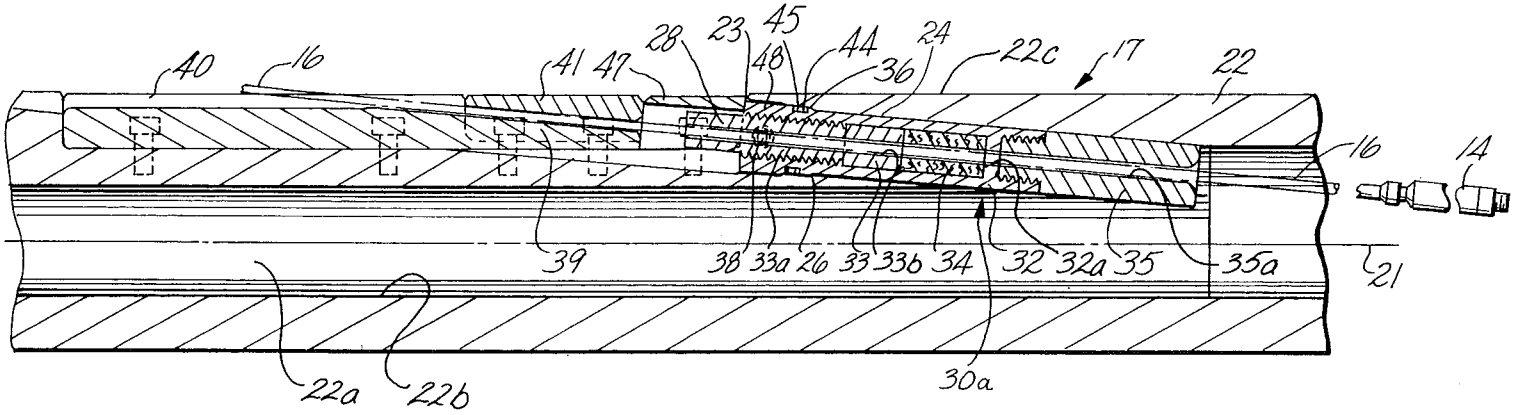
FIG. 2 is a longitudinal cross-sectional view of the cablehead side entry/sub.

The side entry sub 17 is shown in detail in FIG. 2. A generally cylindrical tubular body 22 having a longitudinal central passage 22*a*, an interior wall 22*b*, and an exterior side 22*c* includes a side entrance passage 23 with a cylindrical wall, which runs at a low angle to the axis of the body, formed in a shoulder 23*a* in the sub 17. The body has threaded connections at either end such as a conventional box and pin (not shown), for making up the side entry sub assembly onto the drill string. The outside dimensions and contour of the body 22 conform in general to the standards of the American Petroleum Institute.

The side entrance 23 is an opening or port which passes from the outside to the inside of the sub body. The side entrance has a generally circular cross-section which is at least as wide as a conventional cablehead assembly outside diameter. The side entrance is machined into the side wall of the body 22 at a low acute angle to the drill pipe centerline 21. In an exemplary embodiment the low angle is about 5°, although it may be as large as about 10°. The side entrance 23 is contoured so that a conventional wireline and cablehead assembly can be passed through it.

To prevent loss of mud pressure through the side entrance, a seal is provided by a cartridge assembly 30 which is slidably moved to a seated position in the side entrance against a shoulder 36 in the sub body. The cartridge assembly includes a packoff cartridge 32, adjustable means in the form of a packoff gland 33 for compressing a packing element 34 between the cartridge and the cable, and a wear element 35. The wireline cable is fed through the packoff gland 33, the cartridge 32, and the wear element 35. The wear element and packoff gland are threadably received in opposite ends of the packoff cartridge, concentric with the cartridge. The packoff gland is received in the cartridge by means of a threaded coupling 33*a*. A seal between the packoff gland and the cartridge is provided by the packing elements 34 which are of the conventional string or staggered split ring type. There is a hex head 28 at the outer end of the packoff gland. Turning the hex head causes tightening of the packoff gland into the cartridge to force the packing element to seal tightly about the cable 16 in the cartridge body.

A presently preferred suitable packing element is braided asbestos packing, 5/16" nominal O.D., 0.1 lbs. required, available from many commercial sources, and other packing materials are also suitable.

To make up the cartridge assembly, the wireline cable is fed through central passages 33*b*, 33*a*, and 35*a* in the packoff gland, cartridge body and the wear element, respectively. At this point, the adjustable means is in a first condition permitting the cable to be fed through the cartridge and the port. The cablehead 14 is then electrically and mechanically connected to the wireline which can be accomplished in either the laboratory, in the service shop, or during manufacturing, as desired. The packing elements can be inserted in the cartridge either before or after attaching the cablehead to the wireline.

Figure 3:
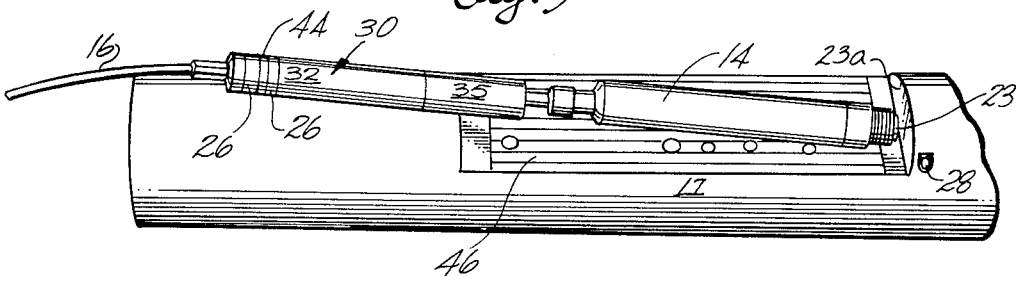
FIGS. 3–6 depict progressive stages in the insertion of a cablehead assembly into the side entry sub.
Figure 4:
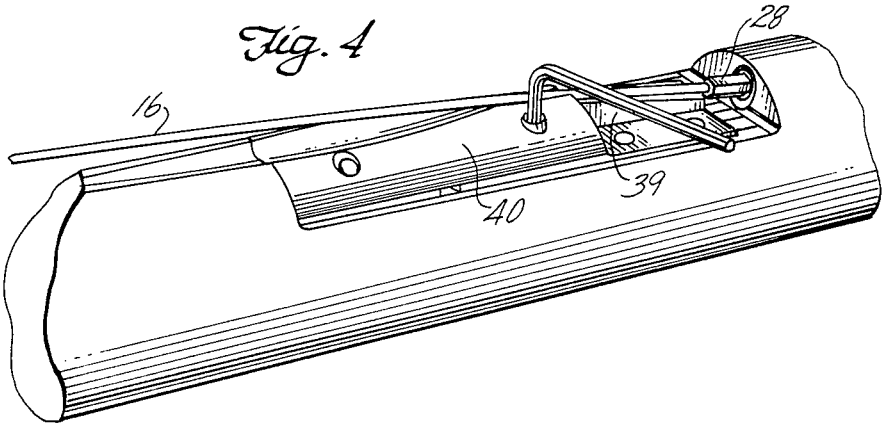
Figure 5:
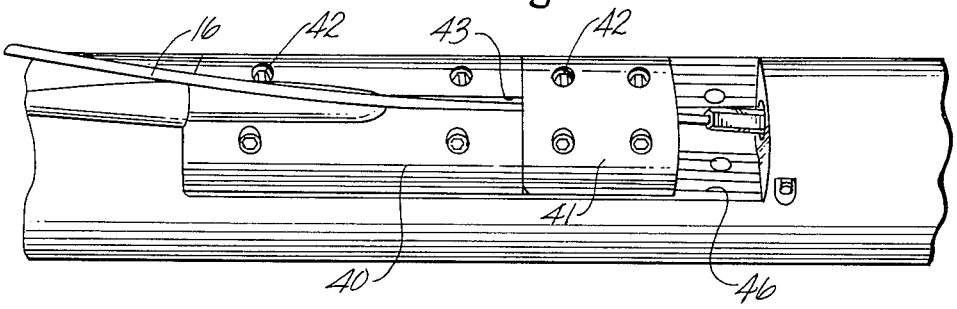
Figure 6:
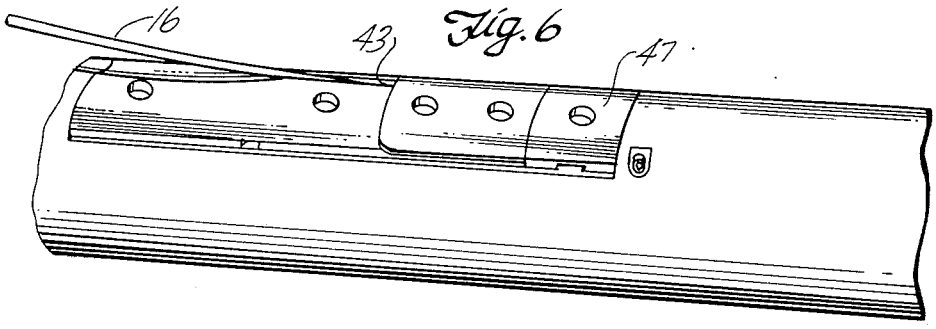

Once the cablehead has been attached to the wireline, there is a good mechanical and electrical connection between the two, and the assembly is ready to be fed into the side entry sub, as depicted in FIG. 3.

At this point during makeup of the side entry sub, the sub body 22 has already been connected to the drill string. The cablehead is inserted through the side entrance and emerges at the lower end of the sub body.

The wireline is fed longitudinally into the sub body through the side opening until the packoff cartridge assembly enters the sub body. The packoff cartridge is dimensioned to slide into the side entrance until a built up sleeve 26 around the first end 48 or upstream edge of the cartridge body contacts a shoulder 36 in the cylindrical wall of the sub body near the opening of the side entrance, preventing further downward movement. The adjustable means also includes a pair of setscrews 38 in the sub body on either side of the side entrance near the shoulder are tightened to prevent the cartridge body from rotating. The setscrews are roughly perpendicular to the axis of or transverse to the side entrance and can be tightened or loosened from the outside of the sub body.

At this point any survey or other wireline tools can be threaded to the exposed end of the cablehead assembly. It is most convenient to first break the drill string at least one joint below the side entry sub unit, connect the tool(s) to the end of the cablehead, and introduce them into the drill string. The drill string connection is remade powertight. The completed cablehead/tool assembly can then be lowered down the drill string to the designated operating position.

The wireline is locked in position by tightening a pair of cover plates 40 and 41 with a plurality of screws 42 to a flat surface 46 on the outside of the cablehead side entry sub body. A guide plate 40 preferably includes a sloping guide groove 43 on its outer surface to guide the cable along the sub body into the side entrance. The lower end of the guide plate includes a grooved ramp 39 which supports the cable when it is clamped in place. The radius of the groove in the ramp is selected to fit the cable closely, as the ramp functions as a lower clamping surface. A second clamping plate 41 is secured over the lower end of the guide plate so that the cable is sandwiched between the clamping plate 41 and the ramp 39 to hold the cable in place and prevent it from slipping. In the presently preferred embodiment about 50 lbs. ft. torque is required to tighten the screws 42 on the cover plate 41 to clamp the cable in place. If desired, the grooved ramp can be provided as a separate piece apart from the guide cover plate 40.

Once the wireline is locked in place, preventing cable slippage, the packoff gland 33 is tightened to seal against fluid passage or loss of pressure along the wireline. The packoff gland is tightened by turning its hex head 28 to thread the gland further into the cartridge body, causing compression of the packing around the cable. At this point, the adjustable means is in a second condition for compressing the packing element within the cartridge and around the cable. Fluid passage or loss of pressure between the outside diameter of the packoff cartridge and the inner wall of the side entrance is prevented by an O-ring 44 and a plurality of backup rings 45 on either side of the O-ring.

Means for retaining the cartridge in the form of a cartridge lock cover 47 is secured to the outside of the sub body to complete the assembly. The cartridge lock positively holds down the packoff cartridge in the sub body. As the cartridge is seated in the entrance and not positively held in place such as by threading, the cartridge lock cover prevents ejection of the cartridge which could otherwise result from positive pressure differences between the inside of the drill pipe to the outside of the drill pipe which are above the holding capacity of the setscrews 38.

The thickness of the wall of the sub body has been increased around the side entrance to maintain the tool strength of the sub body in the drill string. This has been done by increasing the thickness of the wall toward the inside of the sub. However, the sub inside diameter is maintained at least as large as the API I.D. specification for given nominal tool joint sizes. The thickening of the side entry sub wall accommodates the passage of the cable head through the side entry, and locking of the cartridge in the side entry without requiring protrusions at the outside diameter of the sub body which are greater than standard API tool joint outside diameters.

The cover plates 40, 41, and 47 are contoured to follow the outside diameter of the cylindrical sub body without creating protrusions outside of that diameter. The cover plates are secured to the flat surface 46 on the outside of the sub body and serve important functions. The guide plate 40 guides the cable in its transition from outside the sub body into the side entrance. The clamping plate 41 clamps the cable to the sub body (through the ramp 39) to prevent slippage. The cartridge locking plate 46 locks the cartridge in place. The cover plates facilitate the use of a slide-in seated cartridge assembly. By clamping the cable outside the side entrance, the possibility that cable slippage can damage the seal provided by the packing is reduced to acceptable limits. Moreover, the cartridge can be adjusted without interfering with the clamping of the cable. By providing a slide-in cartridge assembly, rather than a cartridge which is, for example, threaded directly into a side entrance to lock it in place, there is no need for machining or maintaining threads in the side entrance itself. Consequently the side entrance can be provided with a smooth inner surface which in turn facilitates passing the cablehead assembly through the side entrance.

The contouring of the outer surfaces of the cover plates to follow the cylindrical shape of the sub body, which is concentric with the axis of the drill string, is particularly advantageous during emergencies when blowout preventer systems must be used to control the well. Conventional blowout preventer systems are designed to operate most effectively on concentric circular drill strings.

The cable head side entry sub unit can be left in the drill string even when wireline instruments are not used. For this application a "blind" cartridge plug of solid construction is provided to replace the packoff cartridge assembly 30 described previously. The cartridge plug has the same outside dimensions as does the cartridge assembly 30 which includes the packoff cartridge 32 and the packoff gland 33. Such a cartridge plug has a solid construction and does not include a central cable passage, as there is no cable running through the side entry sub in this application. The cartridge plug is useful because it prevents leakage of fluids or pressure from the inside of the drill string through the side entrance. The cartridge plug saves the time and effort which would otherwise be required to disconnect the side entry sub from the drill string when it is no longer desired to run wireline instruments into the string.

The described side entry sub can be used to feed wireline tools and instruments other than cablehead into the drill string without disengaging or breaking the lower connection of the sub with the drill string. Such other tools and instruments can be run into the side entry sub as long as the equipment outside diameters are matched to cablehead and the side entrance in the sub body, which enables the equipment to pass through the side entrance. Due to the small angle of approach to the drill string centerline, equipment can pass through the side entrance and yet be substantially longer than the length of the side entrance itself.

The wear element 35 provides a transition from the angled side entrance to the centerline 21 of the drill string. Without a wear element, it would be possible for the cable to rub against the inside wall of the sub body and eventually fray or snap. Once the wear element is in place, the cable will generally hang down the side of the drill string. The wear element can be fabricated from an element which has lower coefficients of friction and wear than conventional cable or wireline so that the wear element, rather than the cable, takes the brunt of wear from frictional contact occurring during normal use.

The wear element also shrouds the cable from the flow of mud at the area where the cable enters the inside of the drill string. The cable undergoes a transition as it tends to follow the direction of the drill string below the side entrance. The cable negotiates a bend or turn of about 5°, which is equal to the angle of the side entrance relative to the drill string centerline. Direct exposure of the cable in this region to the flow of abrasive drilling mud is undesirable and would lead to erosion of the cable. The wear element protects the cable in this critical transition region.

The set screws 38 provide a convenient way to minimize wear of the wear element. There are certain angular positions around the inside wall of the water element which receive more wear than other positions. By loosening the set screws 38, the entire cartridge assembly including the wear element can be rotated relative to the sub body. It is convenient to pull out the cartridge assembly from the entrance as needed to turn the assembly and reinsert it back into position. By turning the cartridge assembly, different angular sections of the wear element can be exposed to the maximum wear occurring in normal use. Once the cartridge assembly has been turned, the set screws are retightened to rotatably lock it in place.

It is not necessary to loosen the cable or reset its packing in the cartridge while rotating the wear element. Thus slippage of the cable through the packing element, which would otherwise lead to pressure leakage through the cartridge, is avoided.

Another advantage to the side entry sub is that the packing can be tightened without disturbing the clamping of the cable. In this application, the cartridge lock cover plate 47 is removed to expose the hex head on the outside of the packoff gland. The rotational set screws 38 are tightened to grip the cartridge, and the hex head on the packoff gland is turned to screw the packoff gland further into the cartridge as necessary to tighten the seal of the packing about the cable. The positioning of the wear element can thereafter be adjusted if desired as described previously, by loosening the rotational set screws 38, turning the cartridge assembly, and retightening the set screws. The cartridge locking plate 47 is thereafter fastened down to lock the cartridge element into place.

This invention has been described in the context of the presently preferred best mode, rather than as a catalog exhaustive of all forms which the invention may take. Accordingly, workers skilled in the art will readily appreciate that modifications or variations in the arrangements and procedures described above may be practiced without departing from, and while still relying upon, essential aspects of this invention.

What is claimed is:

1. An apparatus for admitting a cablehead assembly attached on a cable into a drill string, the apparatus comprising:

a cylindrical tubular sub body for attachment in the drill string and having a substantially central passage therethrough;

an entrance port in a side of the sub body, the port running at an acute angle to a longitudinal axis of the drill string;

a cartridge assembly for sealing the cable in the port against pressure loss, the cartridge assembly being slidably moved to a seated position in the port, the cartridge assembly comprising a cylindrical cartridge and a packoff gland, each having a central passage for receiving the cable;

means for tightening the packoff gland into the cartridge to compress a packing element disposed in the cartridge about the cable to seal between the cable and the cartridge;

means for seating the cartridge assembly in a fixed longitudinal position in the port;

means for clamping the cable to the outside of the body for preventing movement of the cable; and a cylindrical wear element removably attached at one end of the cartridge and extending from the cartridge toward the central passage of the tubular sub body.

2. An apparatus according to claim 1 wherein the wear element comprises a tubular cylindrical member fabricated from a material having a lower coefficient of wear than the cable.

3. An apparatus according to claim 1 wherein the means for seating the cartridge assembly comprises a sleeve on the cartridge and a shoulder in the port for contacting the sleeve on the cartridge to prevent further inward movement of the cartridge assembly into the port.

4. An apparatus according to claim 3 further comprising a first cover plate securable to the outside of the body adjacent to the side entrance for engaging and preventing expulsion of the cartridge assembly from the port.

5. An apparatus according to claim 4 wherein the means for clamping the cable comprises a second cover plate securable to the outside of the body for clamping the cable to the body to prevent further movement of the cable.

6. An apparatus according to claim 5 further comprising a third cover plate securable to the body adjacent to the second cover plate, the third cover plate including a groove for guiding the cable toward the side entrance port.

7. An apparatus according to claim 6 wherein the cylindrical sub body has a recess and an outer contour and wherein the first, second and third cover plates each are mounted in the recess and have a curved outer surface following the contour of the cylindrical sub body.

8. An apparatus according to claim 2 wherein the angle is about 5° to the axis of the drill string.

9. An apparatus for admitting a cablehead assembly attached on a cable into a drill string, the apparatus comprising:

a cylindrical tubular sub body for attachment in the drill string;

an entrance port in a side of the sub body, the port running at an acute angle to a longitudinal axis of the drill string;

a cartridge assembly for sealing the cable in the port against pressure loss, the cartridge assembly being slidably moved to a seated position in the port, the cartridge assembly comprising a cylindrical cartridge and a packoff gland, each having a central passage for receiving the cable;

means for tightening the packoff gland into the cartridge to compress a packing element disposed in the cartridge about the cable to seal between the cable and the cartridge;

means for seating the cartridge assembly in a fixed longitudinal position in the port;

means for clamping the cable to the outside of the body for preventing movement of the cable; and a setscrew in the body transverse to the entrance port for contacting the cartridge.

10. An apparatus according to claim 9 wherein the means for tightening the packoff gland comprises a threaded coupling between the packoff gland and the cartridge for concentrically receiving the packoff gland in the cartridge.

11. An apparatus according to claim 10 further comprising a cylindrical wear element received at one end of the cartridge opposite from the packoff gland for reducing wear of the cable at the entrance port.

12. An apparatus according to claim 11 wherein the wear element may be selectively turned relative to the sub body.

13. A method for introducing a cablehead assembly into a passage along a drill string comprising the steps of:

disposing a cartridge assembly around a cable;

attaching a cablehead assembly to one end of the cable;

feeding the cablehead assembly from outside the drill string through a side entrance in a member of the drill string into the drill string, the side entrance being sufficiently wide to admit the cablehead assembly into the drill string along a path which forms an acute angle with a longitudinal axis of the member;

feeding sufficient cable longitudinally into the side entrance to lower the cablehead assembly to the desired location inside the drill string;

slidably seating the cartridge assembly within the side entrance;

clamping the cable to the outside of the member to prevent further longitudinal movement of the cable relative to the member;

tightening the cartridge assembly about the cable to seal the cable against pressure loss through the cartridge assembly;

securing a cover plate to the outside of the member adjacent the side entrance to prevent expulsion of the cartridge assembly from the side entrance; and attaching a wear element on the cartridge assembly extending to the drill string passage to space the cable from the perimeter of the passage in the drill string.

14. A method according to claim 13 wherein the step of clamping the cable comprises securing a second cover plate over the cable to an outside surface of the member.

15. A method according to claim 13 wherein the cartridge assembly seals against pressure loss from the inside of the drill string through the side entrance.

16. A method for inserting a cablehead attached to a cable into a passage of a drill string having a side entrance, the method comprising the steps of:

assembling the cable and an adjustable cartridge assembly, with the cable passing through the cartridge assembly;

subsequent to the prior step, making up a cablehead assembly on an end of the cable;

subsequent to the prior mentioned steps, introducing the cablehead and the cable into the passage of the drill string through the side entrance;

subsequent to the prior mentioned steps, feeding the cable through the cartridge assembly and the side entrance longitudinally along the drill string to a desired position;

mounting the cartridge assembly in the side entrance;

securing the cartridge assembly in the side entrance of the drill string;

sealing the cartridge assembly to the side entrance of the drill string;

clamping the cable to the drill string to restrict further longitudinal movement of the cable within the drill string; and after the step of clamping, adjusting the cartridge assembly and thereby compressing a sealing element within the cartridge assembly, and thereby forming a seal between the cartridge assembly and the cable.

17. A method according to claim 16 wherein the step of securing the cartridge assembly is performed prior to the step of adjusting.

18. A method according to claim 16 wherein the step of securing comprises the step of securing a member on the drill string exterior to the side entrance to retain the cartridge assembly in the side entrance.

19. A method according to claim 16 comprising the step of attaching a wear protecting element on the cartridge assembly, prior to the step of mounting the cartridge assembly in the side entrance, so that the wear element surrounds the cable, and guides the cable into the passage spaced from an inside wall of the drill string.

20. A method for inserting a cablehead attached to a cable into a passage of a drill string having a side entrance, the method comprising the steps of:

assembling the cable and an adjustable cartridge assembly, with the cable passing through the cartridge assembly;

subsequent to the prior step, making up a cablehead assembly on an end of the cable;

subsequent to the prior mentioned steps, introducing the cablehead and the cable into the passage of the drill string through the side entrance;

subsequent to the prior mentioned steps, feeding the cable through the cartridge assembly and the side entrance longitudinally along the drill string to a desired position;

mounting the cartridge assembly in the side entrance;

securing the cartridge assembly in the side entrance of the drill string;

sealing the cartridge assembly to the side entrance of the drill string;

clamping the cable to the drill string to restrict further longitudinal movement of the cable within the drill string; and after the step of clamping, adjusting the cartridge assembly and thereby compressing a sealing element within the cartridge assembly, and thereby forming a seal between the cartridge assembly and the cable;

wherein the step of securing the cartridge assembly is performed prior to the step of adjusting and wherein the step of adjusting comprises the step of threading one of two parts of the cartridge assembly relative to the other.

21. A method according to claim 20 wherein the step of securing includes the step of preventing rotation of one of the parts of the cartridge assembly.

22. A method for inserting a cablehead attached to a cable into a passage of a drill string having a side entrance, the method comprising the steps of:

assembling the cable and an adjustable cartridge assembly, with the cable passing through the cartridge assembly;

subsequent to the prior step, making up a cablehead assembly on an end of the cable;

subsequent to the prior mentioned steps, introducing the cablehead and the cable into the passage of the drill string through the side entrance;

subsequent to the prior mentioned steps, feeding the cable through the cartridge assembly and the side entrance longitudinally along the drill string to a desired position;

mounting the cartridge assembly in the side entrance;

securing the cartridge assembly in the side entrance of the drill string;

sealing the cartridge assembly to the side entrance of the drill string;

clamping the cable to the drill string to restrict further longitudinal movement of the cable within the drill string;

after the step of clamping, adjusting the cartridge assembly and thereby compressing a sealing element within the cartridge assembly, and thereby forming a seal between the cartridge assembly and the cable; and placing a ring-shaped pressure seal between the cartridge assembly and the side entrance.

23. Apparatus for extending a cable with a mounted cablehead assembly into a drill string, the apparatus comprising:

an elongated sub body having a longitudinally extending central passage therethrough defined by an interior wall, an exterior side on the sub body and a side entrance passage through the sub body from the exterior side to the central passage, the side entrance passage extending at an acute angle to the longitudinally extending central passage;

a removable cartridge assembly comprising first and second cartridge portions adapted for receiving at least one resilient sealing element therebetween, the first and second cartridge portions being adapted for passing such a cable therethrough and through such a sealing element and further being adjustable, one relative to the other, for compressing such a sealing element to form a pressure seal between one of the cartridge portions and such cable, the cartridge assembly being insertable into the side entrance passage from the external side and having an end extending at least to the central passage for guiding such cable, spaced from the interior wall, into the central passage;

means for securing the cartridge assembly in the side entrance passage; and means for clamping such cable to the exterior side of the sub body adjacent the side entrance passage.

24. Apparatus according to claim 23 comprising threads for adjusting the first and second cartridge portions relative to each other.

25. Apparatus according to claim 24 wherein the securing means comprises means for preventing rotation of one of the first and second cartridge portions during adjustment of the first and second cartridge portions.

26. Apparatus according to claim 24 wherein the securing means comprises a setscrew extending from the sub body to one of said first and second cartridge portions.

27. Apparatus according to claim 24 wherein the securing means comprises a member exterior to the side entrance passage for preventing the cartridge assembly from being ejected from the side entrance passage.

28. Apparatus according to claim 24 wherein the sub body comprises a seat in the side entrance passage for seating the cartridge assembly as it is inserted in the side entrance passage from the exterior side.

29. Apparatus according to claim 28 wherein the seat comprises an inwardly extending shoulder in the side entrance passage.

30. Apparatus according to claim 28 wherein the cartridge assembly extends past the seat to the central passage.

31. Apparatus according to claim 26 comprising a resilient pressure seal between the cartridge assembly and the side entrance passage.

32. Apparatus according to claim 23 wherein the cartridge assembly comprises a wear element removably attached at one end of the cartridge assembly and which comprises said end extending at least to the central passage for guiding such cable.

33. Apparatus according to claim 32 wherein the wear element is tubular in shape and passes around such cable.

34. Apparatus according to claim 33 wherein the cartridge assembly and the wear element are rotatable to different wear positions for the wear element, and the securing means comprises adjustable means for preventing such rotation.

35. Apparatus according to claim 23 wherein the side entrance passage and cartridge assembly are substantially circular in cross-section and wherein the diameter of the side entrance passage, where it extends to the central passage, is no smaller than the diameter of the cartridge assembly that is adjacent thereto.

* * * * *